United States Patent [19]

Masimo et al.

[11] Patent Number: 4,831,368

[45] Date of Patent: May 16, 1989

[54] DISPLAY APPARATUS WITH ROTATABLE DISPLAY SCREEN

[75] Inventors: Tamon Masimo, Hiratsuka; Hiroshi Kanazawa, Yokohama; Hidefumi Masuzaki; Satoshi Ito, both of Odawara, all of Japan

[73] Assignees: Hitachi, Ltd., Tokyo; Hitachi Software Engineering Co., Ltd., Yokohama, both of Japan

[21] Appl. No.: 63,104

[22] Filed: Jun. 17, 1987

[30] Foreign Application Priority Data

Jun. 18, 1986 [JP] Japan ..... 61-142614

[51] Int. Cl.[4] ..... G09G 1/06

[52] U.S. Cl. ..... 340/720; 340/723; 340/724; 340/727; 382/46

[58] Field of Search ..... 340/720, 723, 724, 727, 340/789, 798, 799; 382/44, 45, 46

[56] References Cited

U.S. PATENT DOCUMENTS

| | | | |
|---|---|---|---|
| 4,168,488 | 9/1979 | Evans | 340/727 |
| 4,225,929 | 9/1980 | Ikeda | 340/727 |
| 4,267,555 | 5/1981 | Boyd et al. | 340/727 |
| 4,527,155 | 7/1985 | Yamaki et al. | 340/724 |
| 4,542,377 | 9/1985 | Hagen et al. | 340/727 |
| 4,636,783 | 1/1987 | Omachi | 340/727 |
| 4,703,515 | 10/1987 | Baroody, Jr. | 340/727 |

*Primary Examiner*—Gerald L. Brigance
*Assistant Examiner*—Richard Hjerpe
*Attorney, Agent, or Firm*—Antonelli, Terry & Wands

[57] ABSTRACT

An information processing system comprises a display apparatus having a display screen which can be held in position of either vertical elongation or lateral elongation. The information processing system provides the operator with messages necessary for operation. By detecting the position of elongation of the display screen, data for the messages are selectively rotated so as to be always displayed uprightly on the display screen.

10 Claims, 5 Drawing Sheets

VERTICAL ← ROTATION → HORIZONTAL

FIG. 2C
FIG. 2D
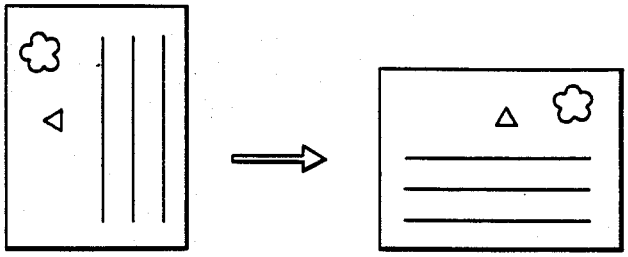
IMAGE DATA (NOT ROTATED FOR DISPLAY WHEN THE DISPLAY SCREEN IS ROTATED)
FIG. 2E
FIG. 2F
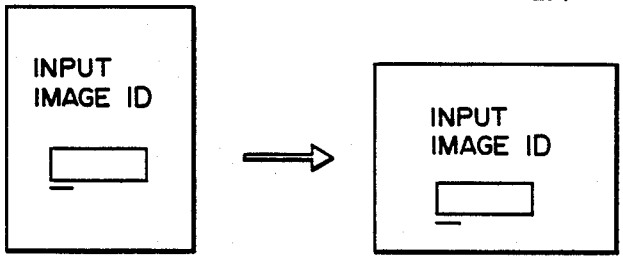
FUNCTIONAL MESSAGE DATA
(ROTATED FOR DISPLAY WHEN THE DISPLAY SCREEN IS ROTATED)
FIG. 3A
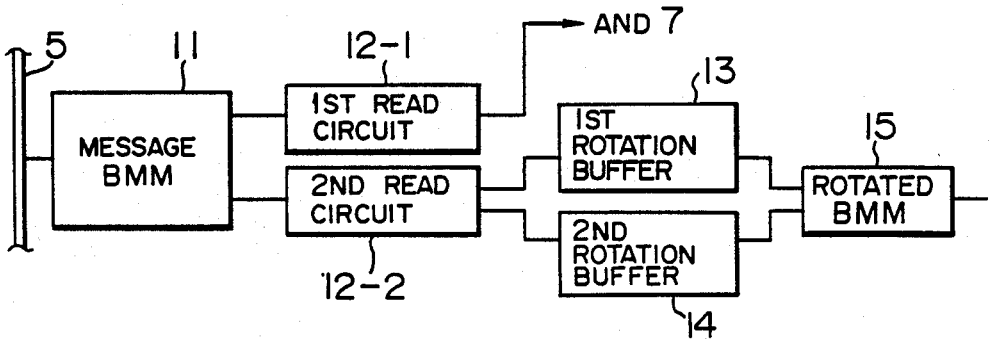

$B=\log_2(m)$ $A=\log_2\left(\frac{m}{n}\right)$

DISPLAY APPARATUS WITH ROTATABLE DISPLAY SCREEN

BACKGROUND OF THE INVENTION

1. Field of the Invention

This invention relates to a display apparatus and more particularly to a display apparatus having a unidirectionally elongated, rotatable display screen.

2. Description of the Related Art

The majority of information processing systems have a display apparatus utilizing a CRT, LCD or the like. The display apparatus has a display screen which is typically rectangular with corners rounded. With regard to display of information on the display screen, either a vertically elongated display or a laterally elongated display is preferred case by case. Such languages as Japanese, Chinese and Korean allow both vertical writing and lateral writing notations and they may sometimes be used properly to comply with the form, vertical elongation or lateral elongation, of the display screen.

Frequently, the information processing system incorporates the display apparatus and a print-out device in combination. In the case where information is edited on the display screen and thereafter printed by means of the print-out device, it is desirable that the display screen match the form of the printing paper.

When pictures are displayed on the laterally elongated screen of the CRT display apparatus and are desired to be printed on vertically elongated printing paper, characters are required to be rotated through 90°, rearranged and then outputted. A method proposed to this end, however, needs a memory of extremely large capacity for storage of image data as well as much processing time before outputting when executing the rotation and rearrangement by using software. Accordingly, another method has been proposed (Japanese Patent Publication No. 57-60671) wherein one frame is divided into many square regions and the rotation and rearrangement is effected for individual square regions. The division of the frame permits a reduction in memory capacity necessary for processing and a reduction in processing time. In this latter proposal, the memory image matrix is divided into a smaller matrix of more cells each having, for example, $8\times8$ bits. Laterally arranged cells of the small matrix are stored in laterally arranged registers and then transferred to and stored in vertically arranged registers, thereby completing rotation of image data.

In still another proposal, the display screen of the display apparatus is made rotatable to match the printing paper. The display apparatus may be used properly such that its display screen is held in a position of lateral elongation when the printing paper is used in a position of lateral elongation or its display screen is held in a position of vertical elongation when the printing paper is used in a position of vertical elongation.

SUMMARY OF THE INVENTION

An object of this invention is to provide a display apparatus with a rotatable display screen which can rotate display information so that image data may readily be displayed on the display screen held in position of either of the vertical elongation and lateral elongation and that functional messages may always be displayed uprightly.

Information to be displayed on the display screen of the display apparatus includes image data (for all of graphics, characters and marks) and functional messages for designating instructions and guidance to the operator.

If all of the information is rotated when the display screen is rotated, a picture of the functional messages, like a picture of the image data, lies 90° sideways on the display screen and the functional messages become difficult to read. Disadvantageously, in the past, it has never been thought of to rotate only the functional messages while refraining from rotation of the image data.

This problem can be solved by handling the image data independently of the functional message data.

A rotatable display screen type display apparatus according to an embodiment of the invention comprises an image display bit map memory (hereinafter referred to as an image BMM) and a functional message display bit map memory (hereinafter referred to as a message BMM) which is independent of the image BMM. When a laterally elongated picture is desired to be displayed on a display screen of a normally vertical type display apparatus, the display screen is rotated so as to be held in a position of lateral elongation, and the rotation of the display screen is detected so that image data may be displayed, without rotation, on the display screen and the contents of the message BMM may be 90° rotated in the direction reverse to the rotation of the display screen and thereafter written into a rotated bit map memory (hereinafter referred to as a rotated BMM). Thus, contents of the rotated BMM are always 90° rotated with respect to the contents of the message BMM. The contents of the rotated BMM and the contents of the image BMM are sequentially displayed. When a picture of vertical elongation is desired to be displayed, the display screen is not rotated and is held in position of vertical elongation and the contents of the message BMM and the contents of the image BMM are sequentially displayed. Since the functional message information can be displayed in the correct direction by merely laying the display screen sidewise, a picture of easy visibility to the user can be obtained and the operational capability can be improved.

These and other objects and advantages will become apparent by reference to the following description taken in conjunction with the accompanying drawings.

BRIEF DESCRIPTION OF THE DRAWINGS

FIGS. 2A to 2F are schematic diagrams useful in explaining the rotational operation of a CRT display device in FIG. 1.

FIGS. 3A and 3B are diagrams for explaining the principle, based on which data in a message BMM shown in FIG. 1 are rotated and written into a rotated BMM shown in FIG. 1.

Figure 1:
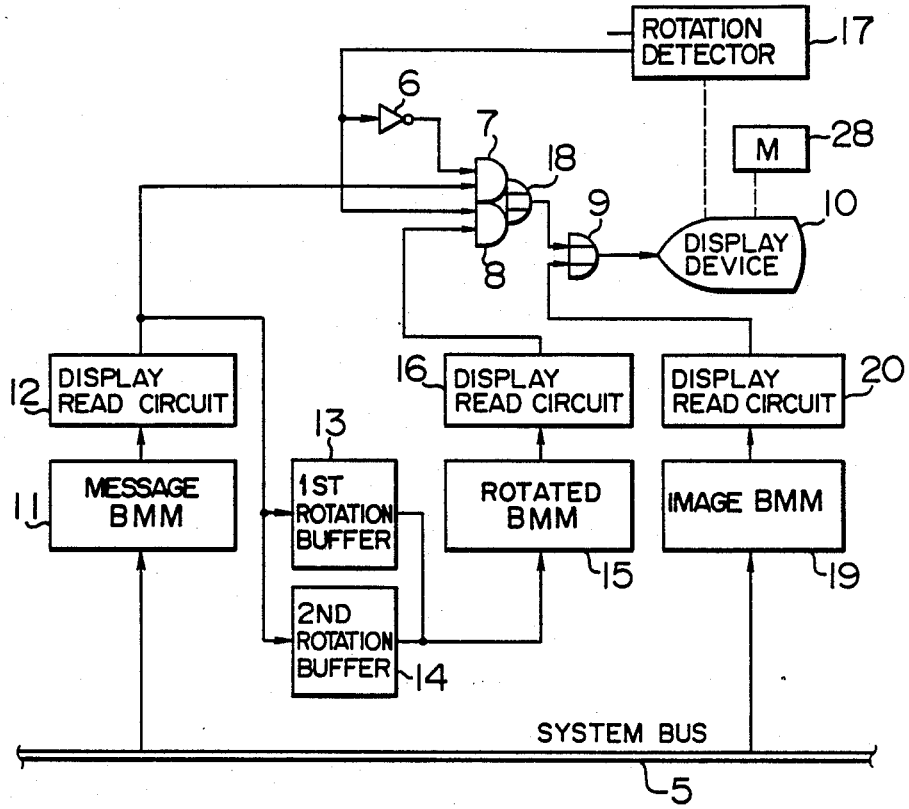
FIG. 1 is a block diagram showing a display apparatus with a rotatable display screen according to an embodiment of the invention.

In various Figures, reference numeral 5 designates a system bus, 6 an inverter, 7 and 8 AND gates, 9 OR gate, 18 an exclusive OR gate 11 a message BMM, 15 a rotated BMM, 19 an image BMM, 13 and 14 rotation buffers, 12, 16 and 20 display read circuits, 21 and 22 positions of vertical elongation and lateral elongation of the CRT display device, 41*a* to 41*d* registers, and 42 a selector.

DESCRIPTION OF THE PREFERRED EMBODIMENTS

Figure 2A:
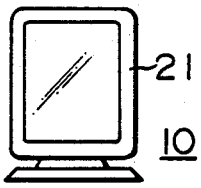
Figure 2B:
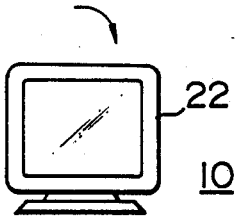

The invention will now be described by way of example with reference to the accompanying drawings, particularly, FIG. 1 illustrating, in block form, a display apparatus with a rotatable display screen according to an embodiment of the invention and FIGS. 2A to 2F illustrating the rotational operation of a CRT display device shown in FIG. 1. The CRT display device as designated by reference numeral 10 in FIG. 1 can be used properly with its display screen held in position of vertical elongation as shown at 21 in Fig. 2A or in position of lateral elongation as shown at 22 in FIG. 2B. The display screen of the CRT display device 10 can be rotated manually or by means of a driver such as a motor in compliance with the kind of display information. Specifically, the display screen is held in position of vertical elongation shown in FIG. 2A to conveniently handle a vertically elongated picture but is rotated to lateral elongation position shown in FIG. 2B to conveniently handle a laterally elongated picture. An example of display of image data is shown in FIGS. 2C and 2D, indicating that the display screen can be 90° rotated without rotating the image data relative to the display screen. For example, a picture for vertically elongated printing paper may conveniently be monitored on the vertically elongated display screen of FIG. 2C and a picture for laterally elongated printing paper may conveniently be monitored on the laterally elongated display screen of FIG. 2D.

However, if message data used for conversation or message transmission (functional message data) between the information processing system and the operator are displayed similarly to the image data, then the functional message data will be displayed so as to lie sidewise on the display screen alternatively positioned as illustrated in FIG. 2C or 2D. Accordingly, the rotation of the display screen is detected by means of a rotation detector so that the functional message data can always be displayed uprightly as shown in FIGS. 2E and 2F.

Referring to FIG. 1, the cathode ray tube (CRT) type display device 10 is adapted to display on its display screen image data and functional message data. Functional message data per frame is stored in a message BMM 11 and read by means of a display read circuit 12 in synchronism with the display cycle. The message data read out of the message BMM 11 is alternately stored in first and second rotation buffers 13 and 14 which serve to rotate the message data and deliver rotated message data. The rotated message data delivered out of the first and second rotation buffers 13 and 14 are stored in a rotated BMM 15. In synchronism with the display cycle, a display read circuit 16 reads the message data from the rotated BMM 15 and supplies it to the display device 10. Image data per frame is stored in an image BMM 19 and read out of the image BMM 19 by means of a display read circuit 20 in synchronism with the display cycle. The display screen of the display device 10 is designed to be 90° rotatable through the use of a rotation mechanism 28. When the display screen is rotated to the lateral elongation position, a rotation detector 17 detects the rotation and produces a detection signal. A logic circuit is responsive to the detection signal to control display of the message data. More specifically, the detection signal is applied to an AND gate 8 while it is inverted by an inverter 6 into an inverting signal which is applied to an AND gate 7. With the detection signal being "1" indicative of rotation, the AND gate 8 is selected so that the data in the rotated BMM 15 can be passed through the AND gate 8 to an OR gate 18. With the detection signal being "0", the AND gate 8 is disabled for passage of data but the AND gate 7 is enabled by the inverting signal from the inverter 6 to pass the data in the message BMM 11. An exclusive OR gate 9 performs positive/negative control of display. In an alternative, the display read circuit 12 may also respond to the detection signal to select the destination of the read data. Transmission and reception of data between the display apparatus and peripheral units are effected through a bus 5.

As an example, the bus 5 is a 32-bit parallel data line, the image BMM 19 is a 512K-byte RAM, each of the message BMM 11 and rotated BMM 15 is a 128K-byte RAM, each of the rotation buffers 13 and 14 is a (8×8)-bit, (16×16)-bit or (32×32)-bit register, and the display read circuit 12 reads (8×8)-bit, (16×16)-bit or (32×32)-bit data, the data being commensurate with the size of the rotation buffers 13 and 14, from the message BMM 11 or reads data to be supplied to the AND gate 7. The read circuits 16 and 20 address the rotated BMM 15 and image BMM 19, respectively. The rotation mechanism 28 is driven by a motor to angularly reciprocate the display screen of the display device 10 through 90°. The rotation detector 17 comprises, for example, a microswitch which is actuated when the display screen of the display device 10 is held in position of lateral elongation. The above description is for illustrative purpose only and in no way limits the present invention.

The operation of the FIG. 1 display apparatus will now be described.

Firstly, when an image is desired to be displayed in vertically elongated form with the display screen of the CRT display device 10 held in the position of vertical elongation, the contents of the image BMM 19 are read by the display read circuit 20 and directly displayed on the display device 10. Contents of the functional message BMM 11 are read by the display read circuit 12 and passed through the AND gate 7 for being displayed on the CRT display device directly or without rotation. The contents of the message BMM 11 are also supplied to the rotation buffers 13 and 14, 90° rotated by the rotation buffers 13 and 14 and stored in the rotated BMM 15. Two stages of first and second rotation buffers 13 and 14 are used herein to ensure that while one of the rotation buffers 13 and 14 is reading data from the message BMM 11, the other can transmit data to the rotated BMM 15. This read and transmit operation is carried out alternately so that the other buffer is subsequently switched to read data with one buffer switched to transmit data to the rotated BMM, thereby permitting the 90° rotation to proceed smoothly.

When the display screen of the CRT display device 10 is 90° rotated by the rotation mechanism 28 so as to be held in the position of lateral elongation, the rotation detector 17 comprised of the microswitch detects the rotation and generates a signal indicative of rotation. This signal disables the AND gate 7 but enables the AND gate 8. As a result, the contents of the rotated BMM 15, that is, functional messages can be displayed on the CRT display device 10. Image data is read by the display read circuit 20 and directly displayed on the CRT display device 10.

More specifically, when the display screen of the CRT display device 10 is rotated by the rotation mechanism 28, the rotation detector 17 detects the rotation to produce the detection signal. Selection of the message BMM 11 when the display screen is held in position of vertical elongation and selection of the rotated BMM 15 when the display screen is held in position of lateral elongation are governed by the polarity of the detection signal. Thus, the rotation detection signal "1" causes the inverter 6 in FIG. 1 to produce the inverting signal "0" which in turn disables the AND gate 7 and consequently prevents passage of data read out of the message BMM 11. The AND gate 8 is enabled by the rotation detection signal "1" to pass data read out of the rotated BMM 15 to the OR gate 18. The data is then passed through the exclusive OR gate 9 and displayed on the CRT display device 10 in alternative or spatially separated relationship with display data read out of the image BMM 19 by the display read circuit 20.

Transfer of data in the message BMM 11 to the rotated BMM 15 is specifically illustrated in a block diagram of FIG. 3A. A first read circuit 12-1 reads data from the message BMM 11 sequentially in the sequence of the scanning line and supplies it to the AND gate 7. A second read circuit 12-2 reads one by one square cells, each being of $(n \times n)$ bits, of a smaller matrix obtained by dividing the message BMM 11 and loads them in either one of the rotation buffers 13 and 14. Data is read out of the rotation buffer 13 or 14 in an order different from the order in which data is written into the rotation buffer 13 or 14, with the result that output data is 90° rotated relative to input data.

Figure 3B:
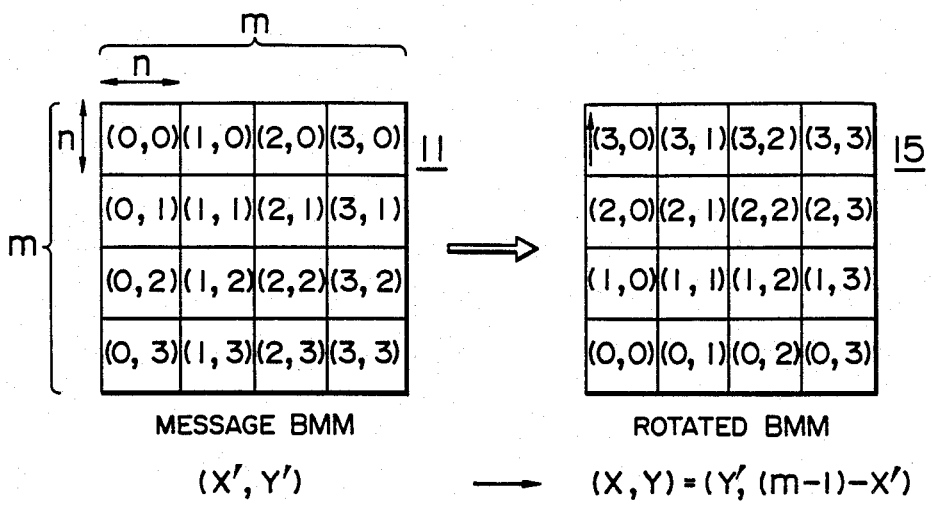

FIG. 3B illustrates a way of rotating transfer of data from the message BMM 11 to the rotated BMM 15. The transfer manner may be stipulated as described in Japanese Patent Publication No. 57-60671, which is incorporated herein by reference. The message BMM 11 is divided into a smaller matrix of $(m \times m)$ cells each being of $(n \times n)$ bits. In FIG. 3B, $m=4$ is assumed and n will be assumed to also equal 4 in the following description. The position of the cell of the small matrix is indicated by coordinates (X', Y') in the message BMM, where $X'=0$ to $(m-1)$ and $Y'=0$ to $(m-1)$. By the rotation processing, a small matrix cell of coordinate (X', Y') in the message BMM 11 is transferred to and stored at a cell of coordinates $(X, Y)=(Y', (m-1)-X')$ in the rotated BMM 15. In this manner, all of the cells of the small matrix can be rotated, thus enabling a right side in the message BMM, for example, to correspond to a top side in the rotated BMM. For example, a cell of coordinate (2, 1) in the message BMM is stored at a cell of coordinate (1, 4-1-2)=(1, 1) in the rotated BMM after the rotation processing has been completed. This is indicated in FIG. 3B by the fact that (2, 1) at the coordinate (2, 1) in the message BMM is stored, after rotation, in the coordinate (1, 1) in the rotated BMM.

For transfer of the small matrix pursuant to FIG. 3B, the message BMM 11 may preferably be addressed such that data in individual cells is read out cell by cell.

Figure 4B:
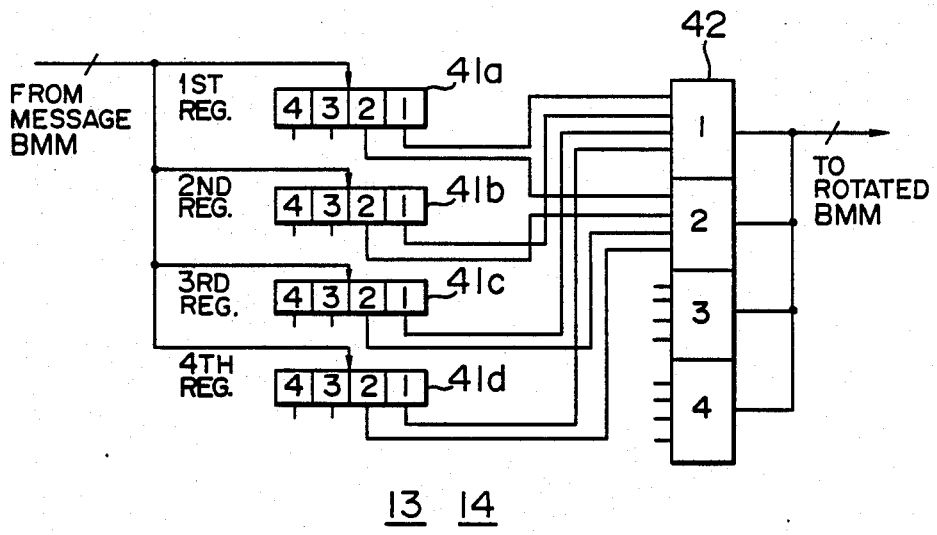
FIGS. 4A to 4C are diagrams showing specified arrangements for implementing the rotation and transfer of data as shown in FIG. 3.
Figure 4C:
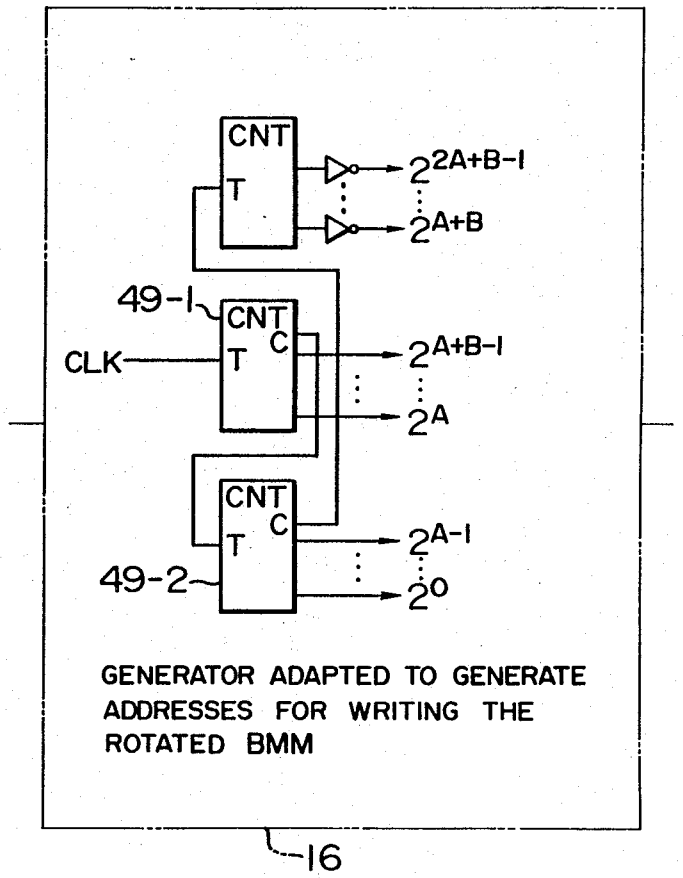
Figure 4A:
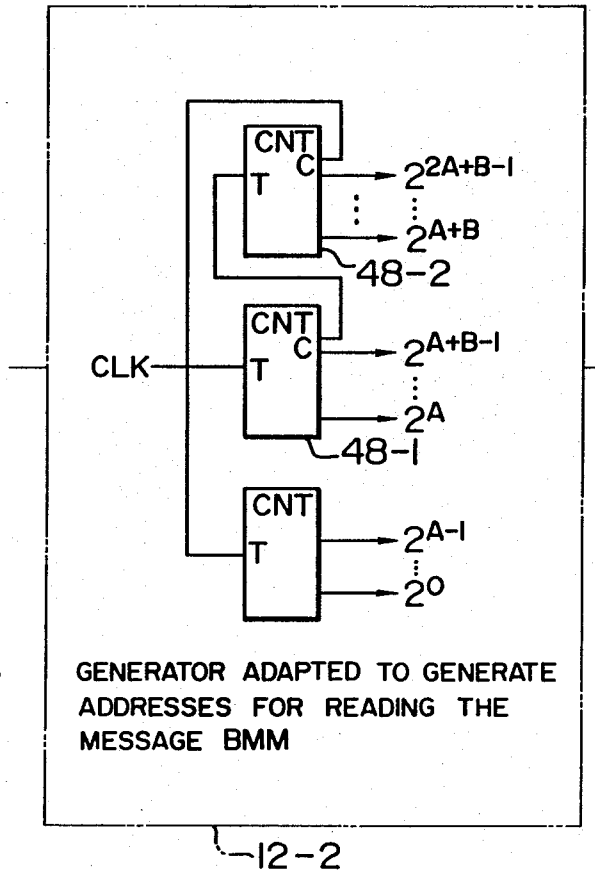

FIG. 4A shows a circuit adapted to generate addresses for reading the message BMM. A plurality of counters 48-1 and 48-2 sequentially count to provide addresses for data bits in individual cells. One counter can provide a series of addresses spaced at predetermined intervals.

The rotation buffer for storing data read out of the message BMM 11 as described above is exemplified in FIG. 4B. When considering $n=4$ in the small matrix of FIG. 3B, one cell contains $(4 \times 4)$ bits. Assuming that 4 bits arranged laterally in line constitute one word, there are 4 words arranged vertically. These 4 words are sequentially loaded on a first register 41*a*, a second register 41*b*, a third register 41*c* and a fourth register 41*d*, respectively, to write the $(4 \times 4)$-bit data in each cell of the small matrix into the first to fourth registers 41*a* to 41*d*. When reading these registers, 4 bits arranged vertically in line are treated as one word. Thus, four bits represented by 1's in the registers 41*a* to 41*d* are read as one word which is inputted to a port 1 of a selector 42, and four bits represented by 2's in the registers 41*a* to 41*d* are read as the following one word which is inputted to a port 2 of the selector 42. Similarly, 3's in the registers 41*a* to 41*d* are inputted to a port 3 of the selector 42 and 4's in the registers 41*a* to 41*d* to a port 4 of the selector 42. Thereafter, the data is outputted from the selector 42 sequentially in the order of ports 1, 2, 3 and 4 and written into the rotated BMM. In this manner, $(4 \times 4)$ bits in each cell of the small matrix can be rotated.

The rotated BMM 15 has a capacity of one frame and data in the small matrix read out of the rotation buffers 13 and 14 is stored at locations, as shown in the right-hand illustration of FIG. 3B, in the rotated BMM 15.

FIG. 4C shows a circuit adapted to generate addresses for writing the rotated BMM 15. Like the address generator circuit of FIG. 4A, a plurality of counters 49-1, 49-2, . . . count sequentially to provide addresses.

Figure 5:
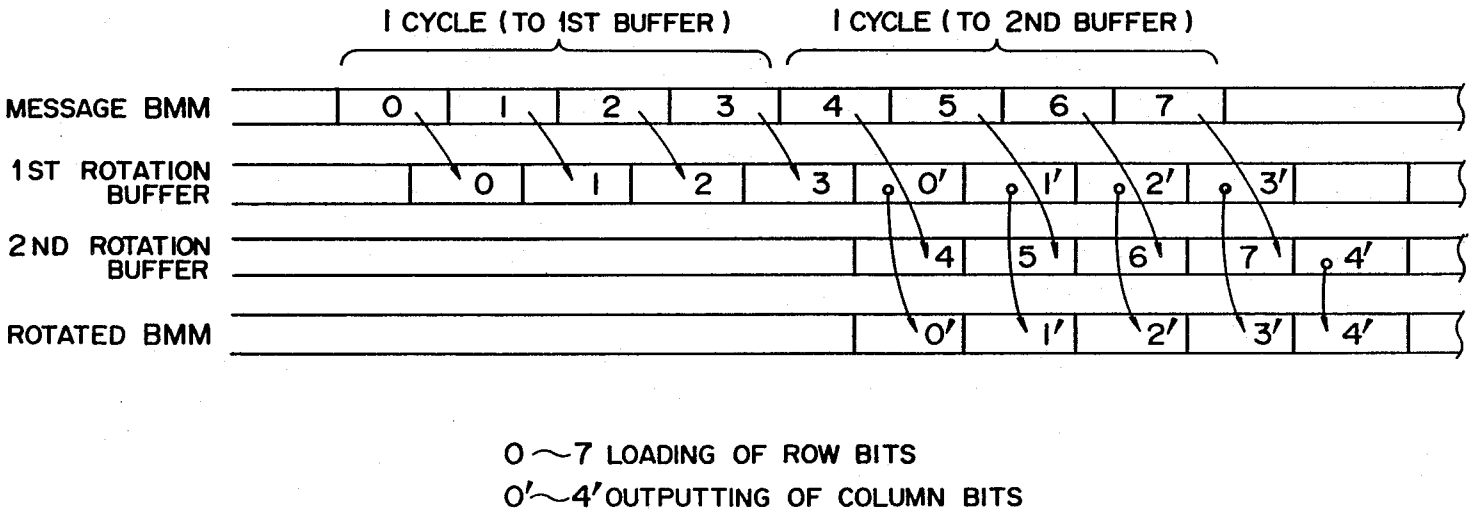
FIG. 5 is a time chart illustrative of the operation of rotation buffers shown in FIG. 4B.

FIG. 5 is a time chart illustrative of the operation of the first and second rotation buffers 13 and 14 shown in FIG. 1. Because of the provision of two stages of rotation buffer, the data input processing from the message BMM and the data output processing to the rotated BMM are carried out alternately and the rotation buffers are operated continuously. This permits the rotation processing to be preformed in real time. In FIG. 5, one word is indicated as one unit and four words constitute one small matrix cell. During the first cycle, one word represented by 0, 1, 2, 3 is transferred from the message BMM to the first rotation buffer and during the following cycle, one word represented by 4, 5, 6, 7 is transferred from the message BMM to the second rotation buffer and at the same time the one word represented by 0, 1, 2, 3 and stored in the first rotation buffer during the first cycle is transferred to the rotated BMM. During the further succeeding cycle (not shown), one word represented by 8, 9, 10, 11 is transferred from the message BMM to the first rotation buffer and concurrently therewith, the one word represented by 4, 5, 6, 7 and stored in the second rotation buffer is transferred to the rotated BMM. In FIG. 5, arrows associated with 0 to 7 indicate loading of row bits on the registers and arrows associated with 0' to 4' indicate outputting of column bits from the registers.

We claim:

1. A rotatable display screen type display apparatus comprising:

a first bit map memory for storing image information;

a second bit map memory for storing functional message information;

a third bit map memory for storing rotated functional message information;

a display device having a rotatable display screen for displaying image information and functional message information;

a rotation mechanism for rotating the display screen of said display device;

means for supplying said image information from said first bit map memory to said display device without changing the orientation thereof regardless of the position of said display device;

rotation detection means for detecting actuation of said rotation mechanism;

data rotation means connected to receive functional message information from said second bit map memory for rotating the received functional message information and for supplying the rotated functional message information to said third bit map memory; and selection means connected to receive a detection signal from said rotation detection means for selectively supplying an output signal form either said second bit map memory or said third bit map memory to said display device.

2. A display apparatus according to claim 1 wherein said data rotation means comprises a plurality of registers each being capable of storing data in cells of a small matrix resulting form division of one frame having rows and columns and effecting a change in direction of writing and reading of data from rows to columns.

3. A display apparatus according to claim 2 wherein said data rotation means comprises mean for generating addresses for accessing data in each cell of the small matrix in said second bit map memory.

4. A display apparatus according to claim 3 wherein said data rotation means comprises means for generating addresses for writing data from said registers into a predetermined cell of the small matrix in said third bit map memory.

5. A display apparatus according to claim 1 wherein said data rotation means comprises two buffers operable as alternate buffers, each buffer being capable of storing data present in each cell of the small matrix resulting from division of one frame.

6. A display apparatus according to claim 1 wherein said selection means comprises a first AND circuit having two inputs for receiving said detection signal and the output signal from said third bit map memory and a second AND circuit having two inputs for receiving an inverting signal of said detection signal and the output signal from said second bit map memory.

7. A display apparatus according to claim 1 wherein said rotation mechanism is driven by a motor.

8. A display apparatus according to claim 1 wherein said display device is a cathode ray tube type display device having a unidirectionally elongated display screen.

9. A display apparatus including display means for displaying images on a unidirectionally elongated display screen which can be rotated, at the operator's own volition, between a plurality of positions, said display apparatus comprising:

as message bit map memory for storing functional message data used for displaying messages to the operator on the display screen;

an image bit map memory having a capacity which is not less than that of said message bit map memory for storing image data;

means for supplying said image data from said image bit map memory to said display means without changing the orientation thereof regardless of the position of said display screen;

data rotation means for sequentially reading data stored in cells of a small matrix in said message bit map memory cell by cell and for changing bit positions of said read data so that said read data can be rotated for display on said display screen; and selection gate means for detecting rotation of said display screen and for passing an output signal from either said message bit map memory or said data rotation means to said display means depending on the position of said display screen, so that said functional message data is always displayed with the same orientation, while the image data is rotated by rotating said display screen.

10. A display apparatus for displaying images on a unidirectionally elongated, rotatable display device which displays synthesized data composed of a function message and image information, said display apparatus comprising:

a rotational mechanism for rotating said display device to a position of vertical or a position of horizontal elongation;

rotation detection means for detecting whether the display device is held in said position of vertical or said position of horizontal elongation; and means for displaying the functional message with a first orientation and the image information with a second orientation, which may be the same or different from said first orientation, on the display device when the rotation detection means has detected that the display device is held in the position of vertical elongation, and for displaying the functional message rotated by 90 degrees with respect to said first orientation and synthesized with the image information having said second orientation on the display device when the rotation detection means detects that the display device held in the position of horizontal elongation.

* * * * *